United States Patent [19]

De Angelo

[11] 4,050,039

[45] Sept. 20, 1977

[54] MAGNETIC TRIP ASSEMBLY

[75] Inventor: Gerald J. De Angelo, Ballwin, Mo.

[73] Assignee: Zinsco Electrical Products, St. Louis, Mo.

[21] Appl. No.: 646,146

[22] Filed: Jan. 2, 1976

[51] Int. Cl.[2] ..... H01H 75/10; H01H 77/06; H01H 81/04

[52] U.S. Cl. ..... 335/38; 335/174

[58] Field of Search ..... 335/38, 35, 23, 21, 335/22, 36, 170, 174, 275, 276

[56] References Cited

U.S. PATENT DOCUMENTS

| | | | |
|---|---|---|---|
| 2,673,264 | 3/1954 | Cole | 335/23 |
| 3,296,564 | 1/1967 | Cellerini | 335/35 |
| 3,421,123 | 1/1969 | Johnson et al. | 335/35 |
| 3,487,343 | 12/1969 | Myers et al. | 335/35 |
| 3,548,358 | 12/1970 | Klein | 335/35 |

*Primary Examiner*—Harold Broome
*Attorney, Agent, or Firm*—Peter Xiarhos; Norman J. O'Malley; Elmer J. Nealon

[57] ABSTRACT

A magnetic trip assembly for use in a device such as an electric circuit breaker. The magnetic trip assembly includes a magnet and an armature arranged with respect to the magnet to coact with a pole face of the magnetic member which is in a plane normal to the magnetic plane of the magnetic member. An electrical load conductor is coupled to the magnetic member and establishes together with the magnetic member a magnetic field for closure of the armature in response to specified, excessive values (short circuit or overload values) of current passing through the load conductor. When the armature is operated to its closed position, a first portion of an actuating and latch member abutting against the armature is caused to move, in turn causing a captive, generally-cylindrical portion of the actuating and latch member to rotate. Rotation of the second portion of the actuating and latch member causes a latch release element extending from the second portion to withdraw, or become unlatched, from the latch mechanism of the circuit breaker, causing the breaker to trip and to thereby protect a load circuit connected with the load conductor.

The magnetic trip assembly in accordance with the invention contains a small number (five) of components, all of which are simple in design and easily fabricated and assembled together. Further, the use of an armature and actuating and latch member in conjunction with a pole face of the magnetic member which is normal to the magnetic plane of the magnetic member results in a substantial mechanical advantage between the armature and the actuating and latch member, thereby producing a definite and positive tripping action by the actuating and latch member.

6 Claims, 3 Drawing Figures

MAGNETIC TRIP ASSEMBLY

BACKGROUND OF THE INVENTION

The present invention relates to a magnetic trip assembly and, more particularly, to a magnetic trip assembly for use in an electric circuit breaker.

Many types of electric circuit breakers employ a magnetic trip assembly for providing instantaneous tripping action in response to short circuits or high current overloads. One common type of magnetic trip assembly employs a magnetic member and an armature physically connected with the magnetic member and adapted to coact with a pole face of the magnetic member parallel to the magnetic plane of the magnetic member. When an excessive amount of current passes through a load conductor coupled to the magnetic member, a strong magnetic field is established in the magnetic member in the air gap between the armature and aforementioned pole face, causing the armature to be drawn through the air gap into physical contact with the pole face ("closed" position). An actuating member engaged with the armature moves together with the armature and causes a trip member (e.g. a trip bar) connected with the actuating member to move (e.g., rotate). The movement of the trip member in turn causes a release or unlatching of the latch mechanism of the circuit breaker. The above-described magnetic trip assembly normally employs a spring connected between the magnetic member and the armature for use in returning the armature to its "open" position after operation, and another spring connected between the magnetic member and the trip member for use in returning the trip member to its latched position after operation.

While the above-described magnetic trip assembly operates in a generally satisfactory manner, it nonetheless has certain shortcomings. A principal shortcoming is that the mechanical advantage achieved between the armature and the trip member of the magnetic trip assembly is somewhat limited by virtue of the particular arrangement of the armature and the actuating and trip members and the use of a pole face which is in the same plane as the magnetic plane of the magnetic member, despite the fact that the magnetic field is strongest in the air gap between the armature and the aforementioned pole face. Further, the above-described magnetic trip assembly has a relatively high component count, includes a number of parts having critical dimensions, and requires a large number of machining and assembly operations, thereby leading to increased manufacturing costs and reduced reliability.

BRIEF SUMMARY OF THE INVENTION

A magnetic trip assembly in accordance with the present invention includes a small number of parts coacting together to avoid the shortcomings of magnetic trip assemblies as discussed hereinabove. The magnetic trip assembly of the present invention generally includes a magnetic member, an armature, an actuating and latch member, a retaining member and a biasing means. The magnetic member has a first portion in a first plane, and a pair of opposed second portions at angles to the first portion. The second portions have pole faces in planes transverse to the plane of the first portion. The magnetic member, when used in the magnetic trip assembly of the invention, is arranged to receive a load conductor adjacent to the first portion, the magnetic member and the load conductor coacting to establish magnetic fields at the aforementioned pole faces in response to the flow through the load conductor of a current having a value greater than a specified value.

The armature of the magnetic trip assembly is coupled to one of the second portions of the magnetic member and is placed through an air gap from the pole face of the other one of the second portions. The armature is operative to move through the air gap into physical contact with the pole face of the other one of the second portions in response to the establishment at the pole face of magnetic fields resulting from the flow through the load conductor of a current having a value greater than the specified value. The aforementioned actuating and latch member is adapted to be confined within a device (e.g., a circuit breaker) to be controlled by the magnetic trip assembly and to engage a latch mechanism of the device. The actuating and latch member is coupled with the armature and is caused to be moved by the armature in response to the aforesaid movement of the armature. This movement of the actuating and latch member disengages the actuating and latch member from the latch mechanism of the device to be controlled.

The aforementioned retaining member is connected to the magnet and the biasing means is connected to the retaining member and to the actuating and latch member. The biasing means operates following the movement of the actuating and latch member and the armature to return the actuating and latch member and the armature coupled therewith to their positions prior to the aforesaid movement of the armature and the actuating and latch member.

BRIEF DESCRIPTION OF THE DRAWING

Various objects, features and advantages of a magnetic trip assembly in accordance with the present invention will be apparent from the following detailed discussion taken in conjunction with the accompanying drawing in which.

DETAILED DESCRIPTION OF THE INVENTION

Figure 1:
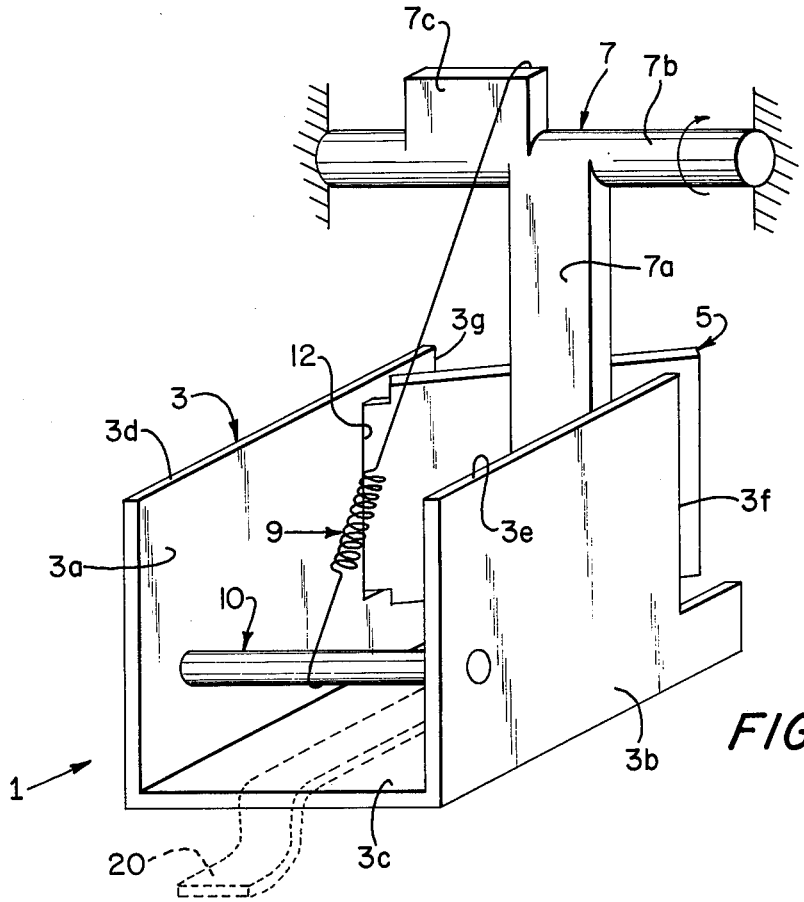
FIGS. 1–3 are enlarged perspective, end and front views, respectively, of a magnetic trip assembly in accordance with the present invention.
Figure 2:
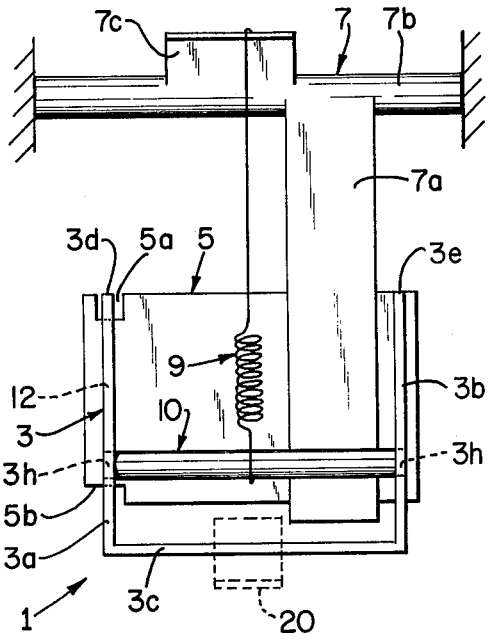
Figure 3:
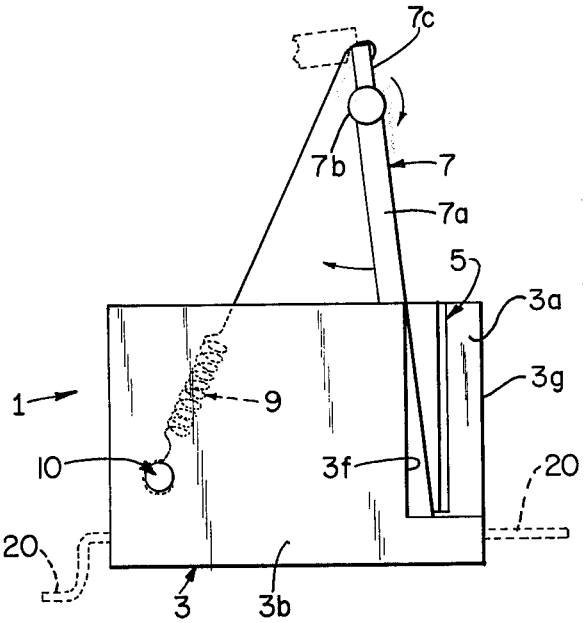

Referring now to FIGS. 1–3, there is shown a magnetic trip assembly 1 in accordance with the present invention. The magnetic trip assembly 1 has a small number of parts, specifically, five, including a magnetic member 3, an armature 5, an actuating and latch member 7, a tension spring 9, and a pin 10.

As shown in FIGS. 1–3, the magnetic member 3 is generally U-shaped in cross-section and includes a pair of flat opposed side portions **3*a* and 3*b* bridged by a flat bottom portion 3*c*. The side portion 3*a* is generally-rectangular in configuration and has a generally-rectangular opening 12 at one end thereof for receiving one end of the armature 5, the armature 5 having portions cut out therefrom at 5*a* and 5*b*, as best shown in FIG. 2, for permitting the easy insertion of the armature 5 into the opening 12 and for limiting the depth of insertion of the armature 5 into the opening 12. The other side portion 3*b* of the magnetic member is generally L-shaped in configuration to establish a space, or air gap, through which the armature 5 is able to move in response to operation of the magnetic trip assembly 1. The magnetic trip assembly 1 is actuated in response to specified excessive values (short circuit or overload values) of current passing through a load conductor 20 (shown in phantom) arranged to pass through the magnetic member 3** along the bottom portion *3c* and intermediate to the side portions *3a* and *3b* as shown in FIGS. 1–3. The magnetic member 3, when used with a load conductor as mentioned hereinabove, has its magnetic plane parallel to the plane of the bottom portion *3c* and has a pair of horizontal pole faces *3d* and *3e* in planes parallel to the magnetic plane and a pair of vertical pole faces *3f* and *3g* in planes normal to the magnetic plane. Normally, in typical prior art magnetic trip assemblies, one of the pole faces corresponding to the pole faces *3d* and *3e* parallel to the magnetic plane of the magnetic member 3 would be used for actuation of the armature 5, the magnetic field of the magnetic member 3 being strongest at these pole faces. However, in accordance with the present invention, and for reasons to be discussed in greater detail hereinafter, the pole face *3f* in a plane normal to the magnetic plane of the magnetic member 3 and associated with the side portion *3b* is used despite the fact that the magnetic field is weaker at this pole face than at the pole faces *3d* and *3e*. The magnetic member 3 as described hereinabove may be suitably fabricated from zinc-plated cold rolled steel. The armature 5 may be suitably fabricated from zinc-plated low carbon steel.

The above-mentioned actuating and latch member 7 is of a unitary construction and includes a first elongated, generally-rectangular actuating portion *7a* abutting against but not physically secured to the armature 5, as best shown in FIGS. 2 and 3, and a second elongated, generally-cylindrical actuating portion *7b* transverse to the first actuating portion *7a*. The actuating portion *7b* further has a latch release element *7c* extending outwardly therefrom, the latch release element *7c* being arranged when the magnetic trip assembly 1 is in the operating position as shown in FIGS. 1–3 to engage the latch mechanism, a portion of which is shown in phantom in FIG. 3, of the device (e.g., a circuit breaker) in which the magnetic trip assembly is to be used. The actuating portion *7b*, when used in a device such as a circuit breaker, is pivotally mounted and confined laterally at the ends thereof, for example, in recesses of the housing of the circuit breaker, but is capable of rotation in a clockwise direction as indicated in FIGS. 1 and 3 in response to actuation of the armature 5 between its open position as shown in FIG. 1 and its closed position. The above-described actuating and latch member 7 may be fabricated from a suitable plastic composition such as sold commercially under the name "Valox", a product of the General Electric Company.

The above-mentioned tension spring 9 is connected at one end thereof around the latch release element *7c* of the actuating and latch member 7 and at the other end thereof around the aforementioned pin 10. The pin 10 is confined between the opposed side portions *3a* and *3b* of the magnetic member 3 by inserting the pin 10 within opposed openings *3h*, indicated in FIG. 2, provided in the side portions *3a* and *3b*. A suitable material for the pin 10 is a standard cotton fabric phenolic resin material.

The operation of the above-described magnetic trip assembly 1 is as follows. When the current in the load conductor 20 intermediate to the side portions *3a* and *3b* of the magnetic member 3 achieves a predetermined excessive value (short circuit or overload value), magnetic fields are established in the air gap between the armature 5 and the pole face *3f* of the magnetic members 3. Although these magnetic fields are weaker than the magnetic fields established at the pole faces *3d* and *3e*, they are of sufficient strength to cause the armature 5 to be drawn through the air gap and to make physical contact with the pole face *3f*. As the armature 5 moved from its open position (as shown in FIGS. 1–3) to its closed position, the elongated actuating portion *7a* of the actuating and latch member 7, which normally abuts against the armature 5 in its open position, as indicated in FIG. 3, is caused to move together with the armature 5 in a generally lateral direction from right to left as shown in FIG. 3. This movement of the actuating portion *7a* of the actuating and latch member 7 causes the actuating portion *7b* of the same member 7 to rotate in a clockwise direction. The clockwise rotation of the actuating portion *7b* causes the latch release element *7c* to also rotate by a slight amount, resulting in the latch release element *7c* withdrawing, or become unlatched, from the latch mechanism of the device (e.g., circuit breaker) with which the magnetic trip assembly 1 is used. The release of the latch mechanism causes a load connected to the associated device to be disconnected from the load conductor, as by the opening of contacts of the associated device, thereby protecting the load from the excessive value of current passing through the load conductor. Following the release of the latch mechanism, the spring 9 causes the actuating and latch member 7 and the armature 5 to be returned to their "latched" (open) positions as shown in FIGS. 1–3.

It will now be obvious that a magnetic trip assembly has been described which offers numerous advantages over prior art assemblies. The magnetic trip assembly 1 has only five components, all of which are simple in design and easily fabricated and assembled together. Further, the use of the particular arrangement of the armature and actuating and latch member in conjunction with a pole face of the magnetic member which is in a plane normal to the magnetic plane of the magnetic member, as opposed to parallel to the magnetic plane of the magnetic member, results in an increased mechanical advantage between the armature and the actuating and latch member and, thus, a definite and positive tripping action on the part of the actuating and latch member. In addition, the particular width of the opening 12 into which the armature 5 is inserted automatically sets the value of the width of the air gap of the magnetic trip assembly.

While there has been described what is considered a preferred embodiment of the invention, it will be obvious to those skilled in the art that various changes and modifications may be made therein without departing from the invention as called for in the appended claims.

What is claimed is:

1. A magnetic trip assembly for use with a latch mechanism of a device to be controlled by the magnetic trip assembly, said magnetic trip assembly comprising:

a magnetic member having a first portion in a first plane, and a pair of opposed second portions at angles to the first portion and having pole faces in planes transverse to the plane of the first portion, said magnetic member being arranged to receive a load conductor adjacent to the first portion and operative to establish magnetic fields at said pole faces in response to the flow through the load conductor of a current having a value greater than a specified value;

an armature coupled to one of the second portions of the magnetic member and spaced through an air gap from the pole face of the other one of the second portions, said armature being operative to move through said air gap into physical contact with the pole face of the other one of the second portions in response to the establishment at the pole face of magnetic fields resulting from the flow through the load conductor of a current having a value greater than the specified value;

an actuating and latch member adapted to be confined within a device to be controlled by the magnetic trip assembly and to engage a latch mechanism of said device, said actuating and latch member being coupled with the armature and operative to be moved by the armature in response to the aforesaid movement of the armature and to become disengaged from the latch mechanism of the device to be controlled;

a retaining member connected to the magnetic member; and biasing means connected to the retaining member and to the actuating and latch member and operative following movement of the actuating and latch member and the armature to return the actuating and latch member and the armature coupled therewith to their positions prior to the aforesaid movement of the armature and the actuating and latch member.

2. A magnetic trip assembly in accordance with claim wherein:

the pole faces of the second portions of the magnetic member are in planes essentially normal to the plane of the first portion of the magnetic member.

3. A magnetic trip assembly in accordance with claim 2 wherein:

the actuating and latch member includes a first elongated portion positioned adjacent to the armature and movable with said armature, a second elongated portion connected transversely with the first portion and adapted to be confined from lateral movement within the device to be controlled by the magnetic trip assembly, and a third portion connected with the second portion and adapted to engage the latch mechanism of the device to be controlled.

4. A magnetic trip assembly in accordance with claim 3 wherein:

the retaining member is a rod-like member connected between the second portions of the magnetic member.

5. A magnetic trip assembly in accordance with claim 4 wherein:

the biasing means includes a spring connected between the retaining member and the third portion of the actuating and latch member.

6. A magnetic trip assembly in accordance with claim 5 wherein:

the magnetic member is adapted to receive the load conductor along the first portion thereof and intermediate to the second portions thereof.

* * * * *